US006543115B1

(12) United States Patent
Mauer et al.

(10) Patent No.: US 6,543,115 B1
(45) Date of Patent: Apr. 8, 2003

(54) PROCESS AND DEVICE FOR JOINING BY PUNCHING AND RIVETING

(75) Inventors: Dieter Mauer, Lollar (DE); Reinhold Opper, Alten-Buseck (DE); Joachim Möser, Ulrichstein-Bobenhausen (DE); Dirk Hermann, Dillenburg (DE)

(73) Assignee: Newfrey LLC, Newark, DE (US)

( * ) Notice: Subject to any disclaimer, the term of this patent is extended or adjusted under 35 U.S.C. 154(b) by 0 days.

(21) Appl. No.: 09/554,573

(22) PCT Filed: Nov. 26, 1998

(86) PCT No.: PCT/EP98/07621

§ 371 (c)(1),
(2), (4) Date: Aug. 15, 2000

(87) PCT Pub. No.: WO99/26743

PCT Pub. Date: Jun. 3, 1999

(30) Foreign Application Priority Data

Nov. 26, 1997 (DE) ..... 197 52 367

(51) Int. Cl.[7] ..... G01M 19/00; B23Q 7/00; B23P 21/00; B23P 19/00; B21J 9/18

(52) U.S. Cl. ..... 29/407.05; 29/407.01; 29/407.08; 29/559; 29/709; 29/798; 29/716; 72/453.07

(58) Field of Search ..... 29/407.05, 407.01, 29/407.08, 559, 798, 709, 716; 72/453.02, 453.06, 453.07; 83/129, 137, 138

(56) References Cited

U.S. PATENT DOCUMENTS

| | | | | |
|---|---|---|---|---|
| 5,678,970 | A | | 10/1997 | Caulk |
| 5,964,026 | A | * | 10/1999 | Jajonlahti et al. ..... 29/559 |
| 6,276,050 | B1 | | 8/2001 | Mauer et al. |
| 2001/0003859 | A1 | | 6/2001 | Mauer et al. |
| 2001/0027597 | A1 | | 10/2001 | Mauer et al. |
| 2001/0039718 | A1 | | 11/2001 | Mauer et al. |

FOREIGN PATENT DOCUMENTS

| | | |
|---|---|---|
| FR | 2 350 901 | 12/1977 |
| WO | WO 93/24258 | 12/1993 |
| WO | WO 94/14554 | 7/1994 |

OTHER PUBLICATIONS

International Search Report for PCT/EP98/07621, completed Apr. 28, 1999, 3 pages.

* cited by examiner

*Primary Examiner*—I Cuda-Rosenbaum
*Assistant Examiner*—John C. Hong
(74) *Attorney, Agent, or Firm*—Edward D. Murphy

(57) ABSTRACT

A method as well as an apparatus manufactures a punch riveted joint, wherein at least two layers are pressed by a holding-down device against the die and a rivet, in particular a semitubular rivet, is provided for joining the layers. The holding-down device is connected by a coupling unit to the punch in such a way that during a punch riveting operation a coupling of the holding-down device to the punch may be varied between a substantially rigid coupling state and an uncoupled state.

59 Claims, 4 Drawing Sheets

Figure 1:
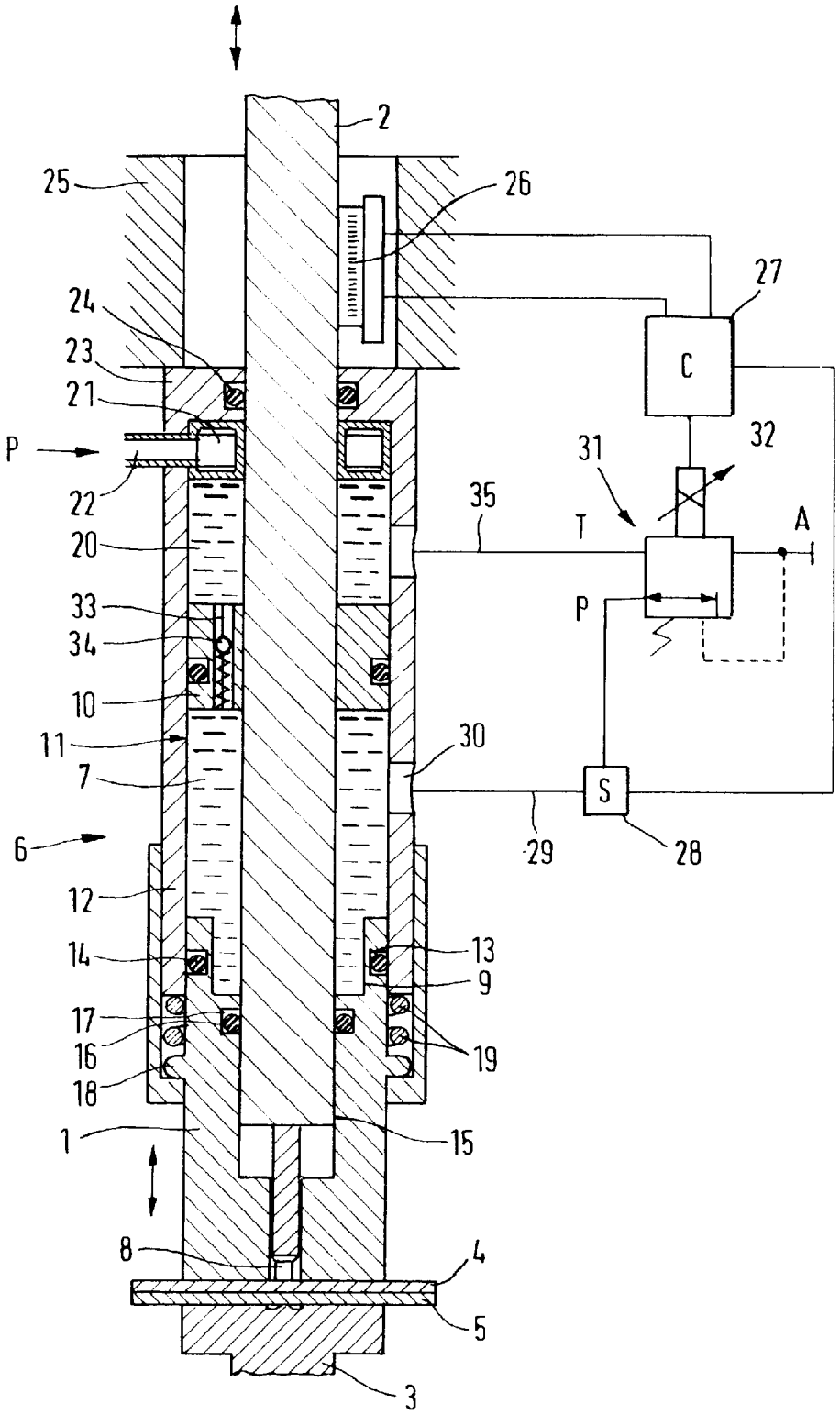

FIG. 3
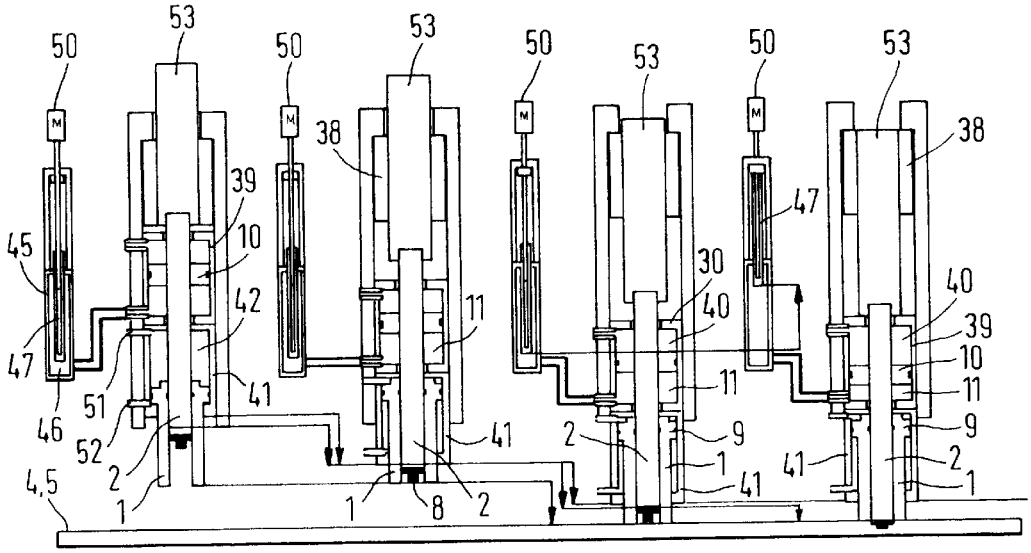
FIG. 4
FIG. 5
FIG. 6
FIG. 7
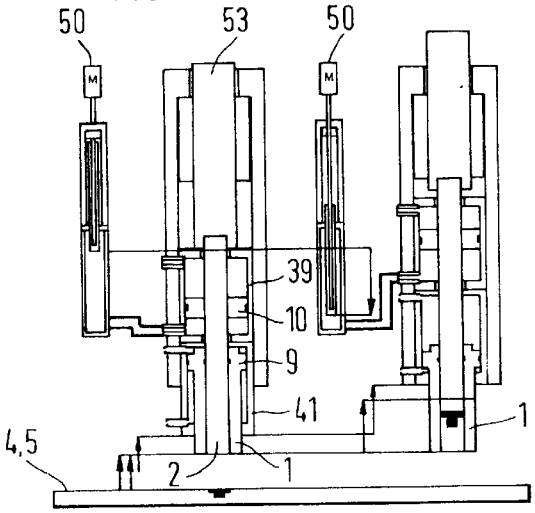
FIG. 8

PROCESS AND DEVICE FOR JOINING BY PUNCHING AND RIVETING

The invention relates to a method as well as to an apparatus for manufacturing a punch riveted joint.

In the automotive industry, in particular, riveted joints are increasingly gaining in importance because they may form an alternative to a weld joint. For material pairings which are difficult to weld, riveted joints are a suitable alternative. By means of punch riveting, the parts to be joined are connected without pre-punching. The pre-punching of the joint parts which is necessary with conventional riveting is replaced by a corresponding cutting operation of the punch rivet.

When punch riveting using a semitubular rivet, the components to be joined are placed onto a die. Said components are fixed on the die by means of a holding-down device. The semitubular rivet cuts through the layer directed towards the semitubular rivet. Then the semitubular rivet is plastically deformed in the bottom layer or layers so as to form a closing head. The configuration of the closing head is determined substantially by the shape of a die. The material punched out of the top layer and, occasionally, out of further layers fills the hollow rivet shank of the semitubular rivet and is held captive therein. The semitubular rivet is then upset so that, on the one hand, a further formation of the closing head is effected and, on the other hand, the head of the semitubular rivet terminates substantially flush with the top layer.

From the article by L. Budde and W. Lappe "Riveting without pre-punching—punch riveting has a promising future in sheet metal working", which appeared in the periodical "Strips Sheets Pipes" 5-1991, pages 95–100, it is known that crucially important factors for a high-quality punch riveted joint by means of a semitubular rivet are, on the one hand, trouble-free fixing of the positioned components so that the relative position of the components is not varied as a result of an after flow movement during punching and, on the other hand, joint-specific selection of a suitable punch rivet in terms of material-specific composition and its rivet geometry.

To ensure that an after flow movement during punching does not occur, it is known from WO 94/14554 for the clamping force of the holding-down device used to fix the components on the die to increase considerably towards the end of the punch riveting operation. A further object to be achieved by said refinement of the method of manufacturing a punch riveted joint is that no annular indentations or distortions arise in the region of the head of the punch rivet.

For effecting the method, WO 94/14554 proposes an apparatus which comprises a die, a holding-down device and a punch. At least two layers of components are clampable between the holding-down device and the die. The holding-down device is movable by means of a first piston/cylinder unit. A second piston/cylinder unit is provided as a drive unit for the punch. The first and the second piston/cylinder unit are operable independently of one another.

A similar refinement of an apparatus for manufacturing a punch riveted joint is known from WO 93/24258. Said apparatus also comprises a piston/cylinder unit, by means of which the required clamping force of the holding-down device may be generated. Differing clamping forces may be generated by suitable pressure control. The apparatus according to WO 93/24258 comprises a second piston/cylinder unit as a drive unit of the punch.

The mechanical properties of a punch riveted joint, in particular the strength characteristics of the punch riveted joint, are dependent upon the formation of the closing head. The strength characteristics are also influenced by the configuration of the region of the components between the head and the closing head of the punch rivet.

Against said background, the object of the present invention is to develop the known method of manufacturing a punch riveted joint in such a way as to achieve, on the one hand, material-sparing manufacture of a punch riveted joint and, on the other hand, a punch riveted joint of greater strength. A further object of the invention is to indicate an apparatus for manufacturing a punch riveted joint, which is suitable for effecting material-sparing manufacture of a punch riveted joint. High strength values of the punch riveted joint manufactured by means of the apparatus are also to be achieved by virtue of the apparatus.

The effect achieved by the method according to the invention for manufacturing a punch riveted joint is that during a punch riveting operation a clamping force exerted by the holding-down device upon the at least two layers may be varied in accordance with a preset characteristic. A variation of the clamping force exerted by the holding-down device upon the at least two layers is achieved in that the holding-down device is connectable by a coupling unit to the punch in such a way that during a punch riveting operation a coupling of the holding-down device to the punch may be varied between a substantially rigid coupling state and an uncoupled state. The effect achieved by said process management is that in the rigid coupling state the holding-down device is movable synchronously with the punch, in particular in the direction of the die. In the uncoupled state a movement of the punch may be effected while maintaining or varying the clamping force exerted by the holding-down device upon the components.

By virtue of the fact that the clamping force exerted by the holding-down device upon the components is variable on account of said clamping force being dependent upon the movement of the punch, the effect is also achieved whereby the requisite clamping force for individual portions of the punch riveting operation is always produced. The amount by which the clamping force is varied is dependent upon the coupling state. In particular, it is proposed that the coupling state is varied as a function of the punch travel or a parameter derived from the punch travel.

Depending upon material pairings as well as upon mechanical properties of the materials of the layers, it may be advantageous for the layers to be pressed initially with a reduced clamping force against the die. Later, the layers may be pressed with a—compared to the reduced clamping force—varying clamping force against the die. In particular, the clamping force should be increased during the upsetting operation. This has the advantage that, in the event of formation of a bead at least partially surrounding the head of the tubular rivet, said bead is upset by the holding-down device in such a way that the head of the tubular rivet terminates flush with the layer. The clamping force may in said case also be much higher than the customary clamping force.

The variation of the coupling state as a function of the punch travel may be effected continuously or discontinuously. Continuous variation of the coupling state is preferred because it does not lead to any abrupt alteration of the clamping force. Alternatively, given discontinuous variation of the coupling state, the jumps in the clamping force may be selected in such a way that no pronounced abrupt alteration of the process parameters occurs.

By virtue of a rigid coupling of the holding-down device to the punch, the holding-down device executes the same movement as the punch. The holding-down device exerts substantially the same force as the punch. In accordance with a preset clamping force characteristic, the holding-down device may be uncoupled from the punch through control of the coupling unit. The further exertion of clamping force by the holding-down device is controlled by means of the coupling unit. When after a preset punch travel the holding-down device is to exert a higher force upon the layers, the holding-down device may be re-coupled to the punch by the coupling unit.

In particular, it is proposed that the holding-down device is moved with the punch relative to the layers to be joined in such a way that the holding-down device presses the layers with a preset clamping force against the die. The holding-device is uncoupled from the punch and the punch is moved further for cutting through at least the layer directed towards the semitubular rivet, forming a closing head and upsetting the semitubular rivet, the holding device optionally being coupled to the punch after a preset punch travel.

A variation of the clamping force as a function of the punch travel is effected preferably in accordance with a preset characteristic of the clamping force as a function of the punch travel. The preset clamping force/punch travel characteristic is in said case a setpoint characteristic, which is preferably compared continuously with the actual characteristic of the clamping force as a function of the punch travel. To said end, it is proposed that a punch travel is measured and it or a parameter derived from the punch travel is compared with a preset setpoint value. Preferably, as a function of the comparison result the holding-down device is uncoupled from the punch or coupled to the punch.

By virtue of the process management according to the invention a gentle plastic deformation of the punch rivet in at least one layer is also guaranteed without excessive weakening of said layer or layers. An excessive weakening of the layer or layers may lead to an unintentional punching-through of said layer or layers. A punching-through of the layer or layers would, depending upon the material pairings, result in corrosion. By virtue of the method according to the invention said problem does not however arise.

According to an advantageous development of the method, it is proposed that the coupling state is varied as a function of the material properties, in particular upon the strength, of at least one layer. The idea behind said advantageous development is that the layers may present differing flow and/or deformation properties. In particular, it is proposed that a clamping force/punch travel characteristic is varied as a function of the properties of the pairing of the layers of different materials. When, for example, a layer of aluminium or an aluminium alloy is to be joined by means of a punch rivet to a second layer of aluminium or an aluminium alloy, then the coupling state is varied in a different manner to a join between aluminium and steel. In so doing, it is also possible to take into account that the coupling state may also depend upon which material properties are presented by the layer to be punched through and/or the layer to be deformed.

For a further improvement of the formation of a punch riveted joint, it is proposed that the coupling state is varied as a function of a thickness of at least one layer, in particular of the layer directed towards the punch rivet. This is to take account of the fact that the flow properties of the layer(s) are dependent also upon the thickness of the layer(s). With a relatively thin layer there is more likely to be a risk of the layer being overstressed in the region of the head of the punch rivet, possibly leading to textures or cracks. This may be avoided by allowing a flow movement of said layer towards the semitubular rivet at least during part of the punch riveting operation, the coupling state being varied from a rigid to a less rigid connection between the holding-down device and the punch. For relatively thick layers the clamping force may be selected higher than for layers of a relatively low thickness because thick layers present stress characteristics of a different kind. Overstressing occurs much later in the thick layer than in a thin layer because there is sufficient material for a flow movement into the die and towards the semitubular rivet.

According to a further advantageous refinement of the method, it is proposed that the coupling state is varied as a function of the material properties of the punch rivet. In particular, the hardness of the punch rivet is proposed as a criterion for varying the coupling state.

The geometry of the punch rivet, in particular the configuration of the free end face of the punch rivet, as well as of the recess of the semitubular rivet also plays a role in the configuration of the riveted joint. The geometry of the punch rivet influences the punching and deformation operation. It is therefore proposed that the coupling state is varied as a function of a geometry of the punch rivet. For the geometry of the punch rivet, individual geometric quantities of the punch rivet may also be used as a criterion. Here, it is possible to use, for example, the cross section of the punch rivet and the length of the punch rivet as factors. The further geometric quantities of a punch rivet may also be used as criteria for the selection of a suitable coupling state characteristic.

In particular, the coupling state may at least during at least one part of an upsetting operation be reduced to such an extent as to enable a movement of at least one layer in a direction substantially at right angles to the semitubular rivet. The effect thereby achieved is that a material flow occurs during the formation of the closing head so that the layers in the region of a punch riveted joint are subject to a lower mechanical stress, in particular to a tensile load.

As a further criterion for the process management, a punch force of the punch may be determined and compared with a preset setpoint value, the holding-down device preferably as a function of the punch force and/or the punch travel being uncoupled from the punch or coupled to the punch. Additionally or alternatively, during the punch riveting operation the clamping force of the holding-down device may be determined and compared with a preset setpoint value. On the basis of the comparison, the clamping force may be varied as a function of the punch travel.

A setpoint characteristic curve of a clamping force/punch travel characteristic may be determined on the basis of experiments. Here, it has first to be assumed that such a setpoint characteristic curve is valid for the specific punch riveted joint formed during the experiment. For punch riveted joints which vary in terms of the material properties of the layers, their geometry, etc., corresponding further setpoint characteristic curves have to be determined. In a first approximation, when determining a setpoint characteristic curve for a preset punch riveting task, it is possible by extrapolation of the known setpoint characteristic curves to determine an assumed setpoint characteristic curve which may serve as a basis for the comparison with the clamping force/punch travel characteristic.

In view of the fact that the layers may within the manufacturing tolerances differ in thickness, it is proposed that the holding-down device is coupled to the punch as a function of a punch force. A coupling of the holding-down device to the punch may also be effected when the punch force and the travel of the punch lie within a specific tolerance zone.

According to a further advantageous refinement of the method, it is proposed that a clamping force of the holding-down device is measured directly or indirectly. The holding-down device may as a function of the clamping force and/or the punch force and/or the travel of the punch be uncoupled from the punch or coupled to the punch.

It is particularly advantageous when, in the method according to the invention, the holding-down device comprises a piston and the punch comprises a pressure piston, wherein the piston and the pressure piston are movable relative to one another inside a common chamber, wherein a fluid, preferably a substantially incompressible fluid, is provided between the piston and the pressure piston, wherein the distance of the piston and the pressure piston relative to one another is varied substantially by means of the fluid, in particular the fluid volume. The chamber with the fluid as well as the piston and the pressure piston form the coupling unit. By varying the volume or pressure of the fluid between the piston and the pressure piston, the coupling state between holding-down device and punch may be varied. When the fluid volume is constant, in particular given a substantially incompressible fluid, there is a rigid connection between the punch and the holding-down device. Upon a movement of the punch, the holding-down device effects a positional variation corresponding to the punch travel. When the fluid volume is varied during the punch movement and indeed in such a way as to be reduced, then the punch effects a greater punch movement than the holding-down device. The holding-down device may, given a corresponding variation of the fluid volume, be stationary, in which case the force exerted by the holding-down device upon the components may be varied variably or constantly as a function of the fluid volume. In a corresponding manner, the coupling state may be influenced by the fluid pressure.

Preferably at least part of the fluid is directed out of the chamber into a compensating chamber, with the result that the relative position of the piston and pressure piston is varied. The speed at which a positional change of the piston and pressure piston occurs may be influenced by the rate of flow of the fluid out of the chamber. By means of the flow rate, therefore, the rate of change of the clamping force is also influenced. For the formation of a further punch riveted joint, the fluid which has flowed out of the chamber into a reservoir is conveyed out of the compensating chamber back into the chamber, thereby achieving a closed-circuit fluid system.

For the formation of a further punch riveted joint, the fluid which has flowed out of the chamber into a reservoir is conveyed out of the compensating chamber back into the chamber, thereby achieving a closed-circuit fluid system.

According to a further advantageous refinement of the method, it is proposed that the holding-down device is connected to a piston disposed in a double-action cylinder, through which the punch extends. The punch comprises a pressure piston guided in a chamber, which is loadable with a preferably incompressible fluid. The chamber is connected to a reservoir of variable volume. The chamber is connected rigidly to the cylinder and guided displaceably in a housing.

The variation of the fluid pressure is effected preferably as a function of the punch travel and/or the travel of the holding-down device and/or the clamping force and/or the punch force. Preferably, a fluid pressure is determined as a function of the punch travel and the fluid pressure/punch travel characteristic is compared with a preset setpoint characteristic. As a function of the comparison, a pressure control valve fluidically connected to the chamber is activated. The fluid pressure in the chamber is controlled by the pressure control valve. Preferably, the fluid removal is controlled as a function of the clamping force and/or the punch force and/or the travel of the punch and/or the travel of the holding-down device.

When no fluid is removed from the chamber, the pressure piston effects a pressure build-up of the fluid in the chamber, with the result that the fluid exerts a pressure upon the piston of the holding-down device and the holding-down device is moved towards the layers. Once the holding-down device has applied the force required to clamp the layers between the holding-down device and the die, the punch may be moved further, for example, through suitable removal of fluid from the chamber, such that the clamping force between holding-down device and die is maintained. When a more extreme change of volume is effected by fluid removal from the chamber than the change of volume occasioned by the variation of the punch travel, the clamping force of the holding-down device decreases and the punch effects the actual punch riveting operation. This may be effected by no removal or only a lower removal of fluid from the chamber when the layers are to be pressed initially with a reduced clamping force against the die and then with a higher clamping force against the die (compared to the reduced clamping force).

According to a further inventive idea, an apparatus for manufacturing a punch riveted joint is proposed which comprises a die, a holding-down device and a punch. The punch and the holding-down device are movable towards and away from the die. At least two layers of components are clampable between the holding-down device and a die. For connection of the layers, a punch rivet which may be, for example, a semitubular rivet or a solid rivet, is driven by means of the punch at least through the layer of the components which is adjacent to the holding-down device. The apparatus according to the invention is notable for the fact that a coupling unit is provided, which connects the holding-down device and the punch in such a way that during a punch riveting operation a coupling of the holding-down device to the punch may be varied between a substantially rigid coupling state and an uncoupled state. The punch is driven by means of a drive unit. A perceived advantage of said refinement of the apparatus is that the holding-down device is moved as a function of the punch. Also, by virtue of the fact that the holding-down device may be coupled substantially rigidly to the punch, a clamping force is achieved relatively quickly.

According to a further advantageous refinement of the apparatus, it is proposed that the holding-down device comprises a piston head and the punch comprises a pressure piston. The piston and the pressure piston are movable relative to one another in a chamber of the coupling unit which is filled with a preferably incompressible fluid, the fluid pressure in the chamber being variable.

According to a further advantageous refinement of the apparatus, it is proposed that a control device is provided, which is used to activate the coupling unit. The effect achievable by means of the control unit is that during a punch riveting operation, via the coupling unit, a clamping force exerted by the holding-down device upon the at least two layers is varied in accordance with a preset characteristic as a function of at least the punch travel or a parameter derived from the punch travel. The fluid pressure may be controlled by fluid removal from the chamber so that the position of the piston relative to the pressure piston is dependent upon the volume of the removed fluid. When no fluid is removed, there is a substantially rigid connection between the piston and the pressure piston so that the holding-down device is moved synchronously with the punch. Through suitable removal of the fluid the clamping force may be maintained or varied, even though the punch with the pressure piston is moving in the direction of the layers. The fluid removal may also be controlled in such a way that suitable clamping force profiles of the holding-down device may be realised.

The apparatus preferably comprises a compensating chamber, into which at least some of the fluid from the chamber may be fed through at least one line during a punch riveting operation, said fluid being fed out of the compensating chamber and back into the chamber for a new punch riveting operation. At least one line containing a pressure control valve is preferably provided between the compensating chamber and the chamber. The fluid pressure in the chamber may be controlled by the pressure control valve. For automatic control of the apparatus, it is proposed that a pressure sensor for measuring the fluid pressure is provided, which is connected to the control device. The pressure control valve is likewise connected to the control device. Preferably, a fluid pressure is determined as a function of the punch travel and a fluid pressure/punch travel characteristic or a parameter characteristic is determined, which is compared by means of the control device with a preset setpoint characteristic, and as a function of the comparison the pressure valve is activated accordingly. The effect thereby achieved is that the clamping force is controlled substantially via the fluid pressure regulation.

According to a further advantageous refinement of the apparatus, it is proposed that the holding-down device is connected to a piston, which is disposed in a double-action cylinder. The punch extends through the cylinder. The punch comprises a pressure piston guided in a chamber, which is loadable with an incompressible fluid. The chamber is connected to a reservoir of variable volume. The chamber is connected rigidly to the cylinder and guided displaceably in a housing.

To achieve a high-quality punch riveted joint, it is proposed that the apparatus employs a displacement measuring device, by means of which at least a travel of the punch is measured, and as a function of the travel of the punch the holding-down device is uncoupled from the punch or coupled to the punch. The characteristic of the variation of travel of the punch may be used as an indication of the quality of the punch riveted joint to be achieved. A quality check of the punch riveted joint may be carried out already during the formation of the punch riveted joint. The displacement measuring device is preferably disposed on the punch. Alternatively or additionally it is proposed that the apparatus comprises a measuring device, by means of which a punch force of the punch is measured or determined, the holding-down device as a function of the punch force and/or the punch travel being uncoupled from the punch or coupled to the punch.

Alternatively or additionally it is proposed that the apparatus comprises a measuring device, by means of which a punch force of the punch is measured or determined, the holding-down device as a function of the punch force and/or the punch travel being uncoupled from the punch or coupled to the punch.

The measurement of the clamping force of the holding-down device may also be used for quality assurance purposes. In particular, by measuring the travel of the punch, the force of the punch and/or the clamping force of the holding-down device, it is possible to determine the appropriate instant for uncoupling or coupling of the holding-down device to the punch.

The displacement of the holding-down device may also be measured using suitable means. The displacement measurement of the holding-down device may be used as an indication of the thickness of the layers of components to be joined so that the travel of the punch may be determined knowing the thickness of the layers. This is important particularly when the thickness of the layers owing to manufacturing tolerances lies within a tolerance zone. This also prevents, e.g. in the case of a punch riveted joint produced by means of a self-piercing punch rivet, the bottom layer from not being cut through by the punch rivet. By means of the holding-down device the layers may also be pressed towards one another in such a way that they rest against one another before the actual punch riveting operation is initiated.

The driving of the punch may be effected by means of a hydraulic drive unit. Instead of a hydraulic drive unit, it is alternatively proposed that the punch is driven by means of a motor-operated, in particular an electric motor-operated, drive unit. By means of the drive unit, the punch executes a substantially linear motion. Further details and advantages of the method as well as of the apparatus are described with reference to a preferred embodiment.

Figure 2:
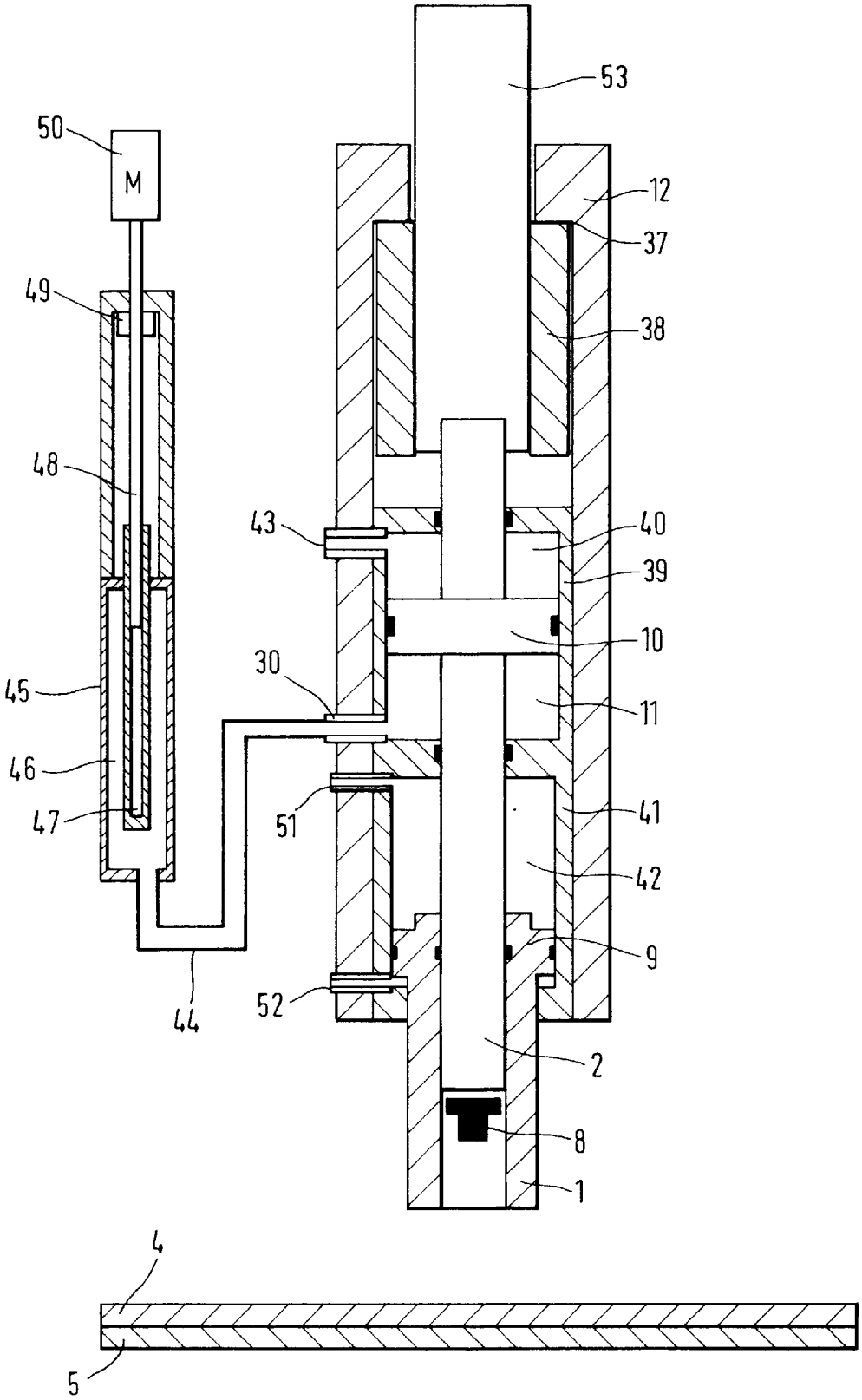
Figures 9, 10:
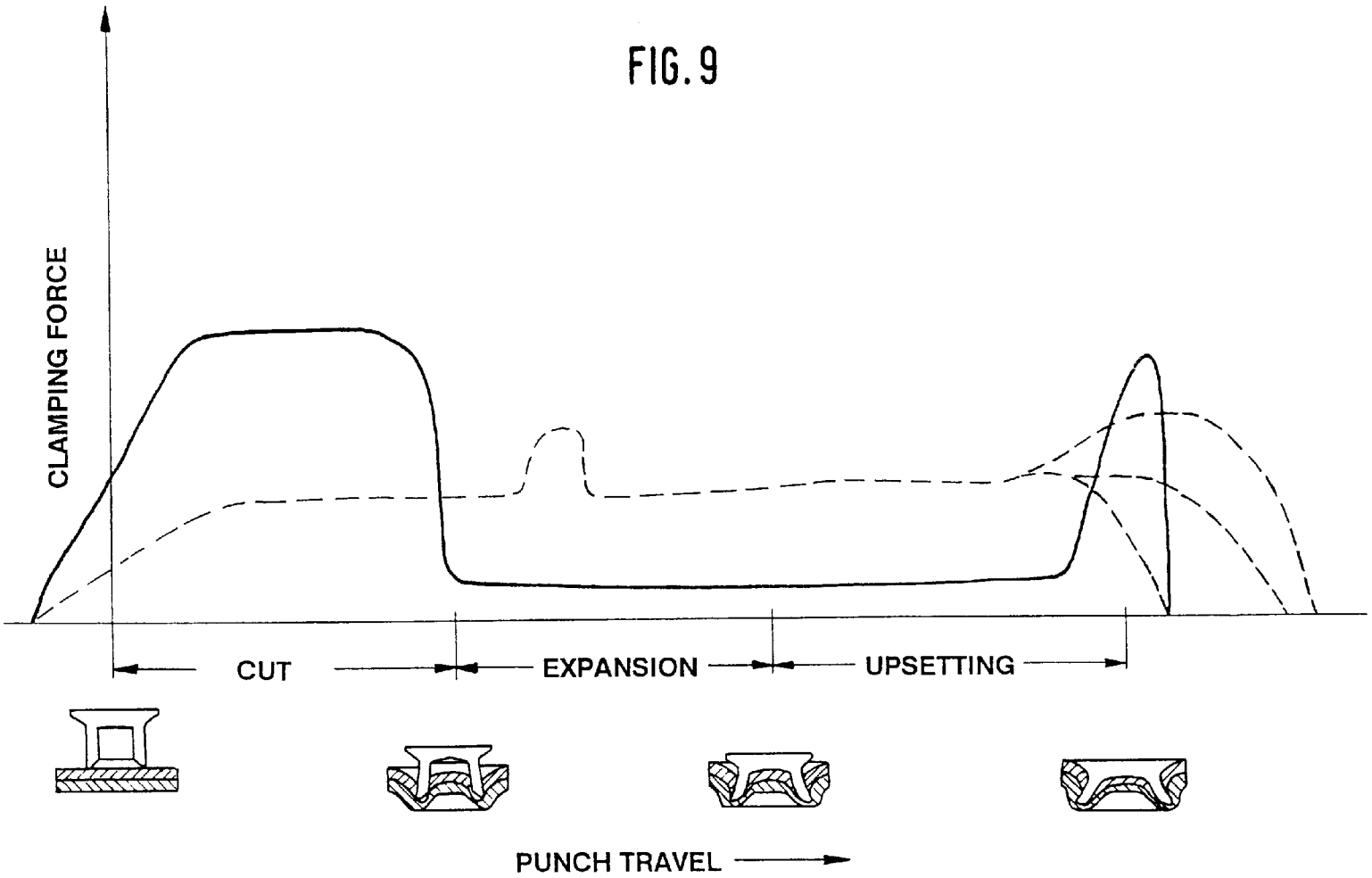

Further details and advantages of the method as well as of the apparatus are described with reference to a preferred embodiment. In the drawings:

FIG. 1 is a diagrammatical section through a first embodiment of an apparatus for manufacturing a punch riveted joint, FIG. 2 is a diagrammatical section through a second embodiment of an apparatus for manufacturing a punch riveted joint, FIGS. 3 to 8 are snapshots during a punch riveting operation of the apparatus according to FIG. 2, FIG. 9 is a graph illustrating a clamping force as a function of the travel of the punch, and FIG. 10 is a diagrammatic, sectional view of an apparatus for manufacturing a punch riveted joint.

DETAILED DESCRIPTION OF THE PREFERRED EMBODIMENT

The apparatus comprises a holding-down device 1, a punch 2 and a die 3. The holding-down device 1 is movable towards and away from the die 3. In the view according to FIG. 1, two layers 4, 5 of components are shown between the die 3 and the holding-down device 1. The layers 4, 5 are clamped between the holding-down device 1 and the die 3. A punch rivet 8 is diagrammatically illustrated, which rests on the layer 4. The holding-down device 1 surrounds the punch 2. The punch 2 also is movable towards and away from the die 3.

The apparatus comprises a coupling unit 6, which connects the holding-down device 1 and the punch 2 in such a way that during a punch riveting operation a coupling of the holding-down device 1 to the punch 2 may be varied between a substantially rigid coupling state and an uncoupled state. To said end, the coupling unit 6 comprises a piston 9 connected to the holding-down device 1. Connected to the punch 2 is a pressure piston 10. The piston 9 and the pressure piston 10 are displaceable relative to one another inside a chamber 11. The chamber 11 is delimited by a housing 12. The chamber 11 is filled with a, preferably substantially incompressible, fluid 7. The fluid pressure inside the variable-volume chamber 11, which is delimited by the housing 12, the piston 9 and the pressure piston 10, is variable.

The piston 9 has a circumferential groove 13, in which a sealing ring 14 is disposed. A sealing of the piston 9 relative to the inner shell of the housing 12 is thereby achieved. Formed inside the piston 9 is a through-opening 15, through which the punch 2 extends. Also provided between the lateral surface of the through-opening 15 and the punch 2 is a fluid-tight connection formed by a sealing ring 16, which is disposed in a groove 17 of the piston 9.

Provided on the outer shell of the housing 12 is a housing part 18, in which a recuperating spring 19 is disposed. The housing part 18 is connected to the housing 12. Preferably, the housing part 18 is screw-connected to the housing 12. The recuperating spring 19 is connected by its one end to the holding-down device 1 and by the opposite end to the housing 12. Upon a movement of the holding-down device in the direction of the layers 4, 5 the recuperating spring 19 is tensed. The holding-down device 1 may be retracted by the initial tension of the recuperating spring 19.

A compensating chamber 20 is formed at the end face of the pressure piston 10 remote from the chamber 11. The compensating chamber 20 has a connection 22, through which an elastic compensating element 21 is loadable with pressure. The punch 2 extends through an end plate 23. Disposed in the end plate 23 is a sealing element 24, which lies sealingly against the outer shell of the punch 2.

The housing 12 is connected to a frame 25. FIG. 1 shows a displacement measuring device 26, by means of which the punch travel is measurable. The displacement measuring device 26 is connected to a control device 27. The control device 27 is connected by a sensor line 36 to a pressure sensor 28. The pressure sensor 28 is disposed in a line 29, which is connected by a connection 30 to the chamber 11. A line 35 leads to the compensating chamber 20. In the line 35 is a pressure control valve 31, which is connected by a control line 32 to the control device 27.

By means of a non-illustrated drive unit the punch 2 and hence also the pressure piston 10 are movable towards and away from the die 3. When the pressure control valve 31 is closed and the chamber 11 is filled with a substantially incompressible fluid, there is a substantially rigid coupling between the punch 2 and the holding-down device 1.

By means of a non-illustrated drive unit the punch 2 and hence also the pressure piston 10 are movable towards and away from the die 3. When the pressure control valve 31 is closed and the chamber 11 is filled with a substantially incompressible fluid, there is a substantially rigid coupling between the punch 2 and the holding-down device 1. Because of the rigid coupling and the movement of the punch 2, the holding-down device 1 also moves towards the die 3. The holding-down device 1 remains rigidly coupled to the punch 2 until the holding-down device 1 exerts a preset clamping force upon the layers 4, 5. The clamping force is determined as a function of the pressure of the fluid in the chamber 11 by the pressure sensor 28.

The punch 2 with the rivet 8 is positioned on the layer 4. Said position forms, for example, a reference position from which a measurement of the travel of the punch 2 is effected. The punch 2 then drives the punch rivet 8 into at least the layer 4. During said process, the travel of the punch 2 is measured by the displacement measuring device 26. The displacement measuring device 26 supplies an output signal to the control device 27. When it has been stipulated that the holding-down device 1, after at least the layer 4 has been cut through, presses with a reduced clamping force upon the layers 4, 5, then as a function of the travel of the punch 2 the pressure control valve 31 is activated by the control device 27. The pressure control valve 31 at least partially clears the line 29 so that a fluid 7 may flow out of the chamber 11 through the line 29. At the same time, the pressure piston 10 moves towards the die 3 without the clamping force of the holding-down device 1 being varied.

The fluid flowing out of the chamber 11 is fed to the compensating chamber 20. During the entire operation, the pressure sensor 28 measures the pressure inside the chamber 11 and communicates it to the control device 27. When the holding-down device is initially to clamp the layers with a reduced clamping force and then press them with a higher clamping force against the die (compared to the instantaneous clamping force), then the pressure control valve 31 is at least partially closed by the control device 27. With the pressure control valve 31 closed, a quasi-rigid connection is re-established between the punch 2 and the holding-down device 1.

During a punch riveting operation, at least some of the fluid flows out of the chamber 11 into the compensating chamber 20. For a new punch riveting operation it is necessary for the fluid to flow out of the compensating chamber 20 back into the chamber 11. This may be effected through the line 35. To achieve the fastest possible return flow of the fluid from the compensating chamber 20 into the chamber 11, a channel 33 containing a check valve 34 is provided inside the piston 10. The check valve 34 is designed so as to enable a return flow of the fluid from the compensating chamber 20 into the chamber 11. When the fluid is a pneumatic oil, potential frothing is thereby avoided. A change in the volume of the fluid as a result of frothing of the fluid in the reservoir may be compensated by the compensating element 21.

The drive unit of the apparatus is preferably operated by an electric motor. The electromotive drive unit is connected by a transmission unit to the punch. The resultant effect is that a rotary motion of the electromotive drive unit is converted by the transmission unit into a linear motion of the punch. By said means a sudden load change of the apparatus, such as occurs, for example, in known hydraulic apparatuses, is avoided. The transmission unit preferably comprises at least one gearing. The gearing is preferably a step-down gearing. This has the advantage of enabling the use of a drive unit having a relatively low torque. The relatively low torque of the drive unit is transmitted by the step-down gearing as a function of the reduction ratio into a correspondingly higher torque or force upon the punch. The electromotive drive unit is preferably connected to the control device.

The clamping force characteristic of the holding-down device may be preselected by means of the control device 27. The control device 27 preferably comprises at least one electronic data processing device.

FIG. 2 shows a second embodiment of an apparatus for manufacturing a punch riveted joint.

FIG. 2 shows a second embodiment of an apparatus for manufacturing a punch riveted joint. The apparatus comprises a substantially cylindrical housing 12. Disposed in the housing is a punch 2. The punch 2 is connected at its one end to a setting spindle 53. The setting spindle 53 is connected to a drive, which is not shown. The setting spindle 53 extends through a spindle nut 38. A thrust bearing 37 is disposed between an end face of the housing 12 and the spindle nut 38.

A cylinder 39 is disposed inside the housing 12. The cylinder 39 is preferably a hydraulic synchronising cylinder. The cylinder 39 comprises a chamber 40 and a chamber 11. The chambers 11, 40 are separated from one another by a pressure piston 10. The latter is connected to the punch 2.

Disposed in the housing 12 is a further cylinder 41, which is firmly connected to the cylinder 39. The cylinders 39 and 40 are supported inside the housing 12 so as to be displaceable in axial direction of the housing. The cylinder 41 delimits a chamber 42, in which a piston 9 is disposed. The piston 9 is connected to a holding-down device 1. The punch 2 extends through the piston 9 as well as through the holding-down device 1, which preferably surrounds the punch 2. In this embodiment, a punch rivet 8 is shown which is disposed inside the holding-down device 1.

The cylinder 39 comprises two connections 30, 43. The connection 30 is connected by a line 44 to a compensating unit 45. The compensating unit 45 comprises a reservoir 46, into which the line 44 opens. Disposed inside the reservoir 46 is a piston 47. The piston 47 is connected by a spindle 48 to a drive 50. The spindle 48 as well as the piston 47 are designed in such a way that the piston 47 may be moved at least partially out of and into the reservoir 46 so that the volume of the chamber varies as a function of the position of the piston 47. The chamber 40 is loadable with air via the connection 43. The cylinder 41 comprises two connections 51, 52, through which preferably air may be introduced into the chamber 42 of the cylinder 41 so that the piston 9 and hence also the holding-down device 1 is movable towards and away from the layers 4, 5.

The mode of operation of the apparatus according to FIG. 2 is described below with reference to the one-shot displays shown in FIGS. 3 to 8. FIG. 3 shows the apparatus 2 in a starting position. The piston 10 is situated in a middle position inside the cylinder 39. The piston 47 of the compensating unit 45 has assumed an end position, in which the volume of the chamber 46 is at its lowest. The piston 9 has assumed an end position, in which the holding-down device 1 is equippable with a punch rivet 8. A punch rivet 8 has been introduced into the holding-down device 1.

The chamber 42 is loaded with compressed air via the connection 52 so that the piston 9 is moved into its second end position. At the same time, the holding-down device 1 moves away from the layers 4, 5. The punch 2 has not altered its position so that the punch rivet 8 is brought into a joining position inside the holding-down device 1. FIG. 4 shows the previously described position of the punch rivet 8 inside the holding-down device 1.

The holding-down device 1 and the punch rivet are at a distance from the components to be joined, as is evident from FIG. 4. Through cooperation of the setting spindle 53 with the spindle nut 38 the punch 2 is moved towards the components. The volume of the chamber 11 remains unaltered. The cylinder 39 and the cylinder 41 are moved with the holding-down device 1 towards the layers 4, 5. The holding-down device 1 exerts a clamping force upon the layers 4, 5.

Upon a further movement of the punch 2 towards the layers 4, 5, the punch 2 exerts a force upon the punch rivet 8, with the result that formation of a punch riveted joint is effected. During the movement of the punch for forming the punch riveted joint, the piston 47 of the compensating unit 45 is moved by the drive 50 in such a way that the volume of the chamber 46 is increased, thereby enabling the fluid to flow out of the chamber 42 into the chamber 46 (FIG. 6).

Upon completion of a punch riveted joint, the holding-down device 1 and the punch 2 are lifted off the layers 4, 5. Said lifting is effected by means of the setting spindle 53, the pressure of the fluid in the chamber 40 preferably being held constant so that the cylinders 39, 41 are moved simultaneously with the movement of the punch, as shown in FIG. 7.

To re-equip the apparatus with a punch rivet, the punch is moved further into its end position. The fluid volume fed out of the chamber 11 into the chamber 46 during formation of the punch riveted joint is fed out of the chamber 46 back into the chamber 11. This is effected by the piston 47 being introduced into the chamber 46 by the drive 50. The chamber 42 is loaded with a fluid so that the piston 9 is moved into its bottom end position. A further punch rivet may be introduced into the holding-down device. The punching apparatus is ready for a new punch riveting operation. A new punch riveting operation may be accordingly effected.

In FIG. 9, a clamping force/punch travel graph is diagrammatically illustrated. The manufacture of a punch riveted joint using a tubular rivet may be subdivided into the following portions: cutting, spreading and upsetting. The characteristic of the individual portions may differ in intensity.

The manufacture of a punch riveted joint using a tubular rivet may be subdivided into the following portions: cutting, spreading and upsetting. The characteristic of the individual portions may differ in intensity.

From the characteristic of the clamping force over the punch travel it is evident that the clamping force increases relatively quickly and is held constant substantially throughout the cutting operation. The characteristic shows that the clamping force during the spreading operation and substantially during the upsetting operation is lower than the clamping force during the cutting operation. The effect achieved by reducing the clamping force is to enable a movement of at least one layer in the direction of the semitubular rivet.

The clamping force/punch travel graph shows that shortly before the end of the upsetting operation the clamping force of the holding-down device increases compared to the reduced clamping force. By said means, any beads or distortions which are formed and rise above the head of the punch rivet are to be pressed into the top layer.

The characteristic of the clamping force as a function of the punch travel is also diagrammatically illustrated. It may be adapted to different punch riveting tasks. In particular, the clamping force characteristic may be selected as a function of the components to be joined, as well as the punch rivet.

The dashes show a further characteristic of a clamping force as a function of the punch travel. The characteristic reveals that the clamping force initially rises up to a preset value and is held at said value. Particularly during an upsetting operation, the clamping force is increased for a preset punch travel and then reduced again.

The apparatus according to the invention is also suitable for other forms of riveted joint, in particular by means of tubular rivets, solid rivets and the like. It is not essential for self-piercing to be effected by a rivet.

What is claimed is:

1. A method of manufacturing a riveted joint in at least two layers using a holding-down device, a punch, a die and a rivet, the method comprising connecting the holding-down device to the punch in such a way that during a punch riveting operation a coupling of the holding-down device to the punch may be varied between a substantially rigid coupling state and an uncoupled state as a function of a characteristic associated with at least one of: the punch, at least one of the layers, the rivet and a force.

2. A method according to claim 1, wherein the coupling state is varied as a function of the characteristic which includes at least one of: punch travel and a parameter derived from the punch travel.

3. A method according to claim 1 or 2, wherein the coupling state is varied as a function of the characteristic which includes material properties of at least one layer.

4. A method according to claim 1, wherein the coupling state is varied as a function of the characteristic which includes properties of a pairing of the layers which are of different materials.

5. A method according to one of claim 1, wherein the coupling state is varied as a function of the characteristic which includes a number of the layers.

6. A method according to claim 1, wherein the coupling state is varied as a function of the characteristic which includes a thickness of at least one of the layers.

7. A method according to claim 1, wherein the coupling state is varied as a function of the characteristic which includes material properties of the punch rivet.

8. A method according to claim 1, wherein the coupling state is varied as a function of the characteristic which includes hardness of a punch rivet.

9. A method according to claim 7 or 8, wherein the coupling state is varied as a function of the characteristic which includes geometry of the punch rivet.

10. A method according to claim 1, wherein the coupling state at least in an end portion of a rivet upsetting operation is varied in such a way that a clamping force exerted by the holding-down device is increased.

11. A method according to claim 10, wherein the coupling state of the holding-down device is varied in such a way that a clamping force is increased so that a head of the rivet terminates substantially flush with the layer directed towards the punch.

12. A method according to claim 1, further comprising moving the holding-down device with the punch relative to the layers, the holding-down device pressing the layers with a preset clamping force against the die, at least partially uncoupling the holding-down device from the punch, further moving the punch for cutting through of at least the layer directed towards the rivet for formation of a closing head and for upsetting of the rivet, wherein the holding-down device is optionally coupled to the punch after a preset punch travel or a parameter derived from the punch travel is achieved.

13. A method according to claim 12, wherein the punch travel is measured and the punch travel or a parameter derived from the punch travel is compared with a preset setpoint value, and the coupling state is varied as a function of the comparison result by the punch.

14. A method according to claim 12 or 13, wherein a punch force of the punch is determined and compared with a preset setpoint value, the coupling state being varied as a function of the characteristic which includes punch force and/or the punch travel.

15. A method according to claim 12, wherein a clamping force of the holding-down device is determined and compared with a preset setpoint value, the coupling state being varied as a function of a parameter of the characteristic selected from the group consisting of the clamping force, a punch force and the punch travel.

16. A method according to claim 1, wherein the holding-down device comprises a piston and the punch comprises a pressure piston, the piston and the pressure piston are movable relative to one another in a chamber of the coupling, which chamber is filled with a substantially incompressible fluid, wherein the fluid pressure in the chamber is varied and the punch is driven by a drive unit.

17. A method according to claim 1, wherein the holding-down device is connected to a piston, which is disposed in a first cylinder, through which the punch extends, the punch is attached to a pressure piston which is guided in a second cylinder, which is loadable with a substantially incompressible fluid and connected to a compensating chamber, wherein the cylinders are rigidly connected and guided displaceably in a housing.

18. A method according to claim 16 or 17, wherein a fluid pressure is regulated as a function of clamping force and/or punch force and/or punch travel and/or travel of the holding-down device.

19. A method according to claim 17, wherein a control element fluidically connected to the chamber is activated as a function of clamping force and/or punch force and/or punch travel and/or travel of the holding-down device or as a function of a setpoint/actual-value comparison.

20. An apparatus for manufacturing a riveted joint, the apparatus comprising:

a die;

a holding-down device;

a punch and the holding-down device being movable towards and away from the die;

at least two layers of components being clampable between the holding-down device and the die;

a punch rivet operably joining the layers, the punch rivet being drivable by the punch into at least the layer adjacent to the holding-down device; and a coupling unit connecting the holding-down device and the punch in such a way that during a riveting operation a coupling of the holding-down device to the punch may be varied by fluid pressure between a substantially rigid coupling state and an uncoupled state.

21. An apparatus according to claim 20, further comprising a piston and a pressure piston, the piston and the pressure piston being movable relative to one another in a chamber of the coupling unit, which chamber is filled with a substantially incompressible fluid, wherein the fluid pressure in the chamber is variable.

22. An apparatus according to claim 21, further comprising a control device operably activating the coupling unit, wherein during a punch riveting operation a clamping force exerted by the holding-down device upon the at least two layers is varied in accordance with a preset characteristic in dependence at least upon the punch travel or a parameter derived from punch travel.

23. An apparatus according to claim 21 or 22, further comprising at least one compensating chamber, at least some of the fluid from the chamber being feedable into and back out of said compensating chamber through at least one line.

24. An apparatus according to claim 23, further comprising a control valve operable with at least the line.

25. An apparatus according to claim 20, further comprising a pressure sensor operably measuring the fluid pressure.

26. An apparatus according to claim 25, further comprising a control device connected to the pressure sensor and to at least one pressure control valve.

27. An apparatus according to claim 26, wherein the fluid pressure is determined as a function of a parameter characteristic derived by using the control device to compare the parameter with a preset setpoint characteristic and the pressure control valve is accordingly activated.

28. An apparatus according to claim 20, further comprising:

a piston, disposed in a cylinder through which the punch extends, connected to the holding-down device; and a pressure piston guided in a cylinder loadable with a substantially incompressible fluid, the cylinder being connected to a reservoir, the volume of which is variable, and the pressure piston being connected to the punch;

wherein the cylinders are connected rigidly to one another and guided displaceably in a housing.

29. An apparatus according to claim 20, further comprising a displacement measuring device operably measuring travel of the punch, wherein the coupling state is varied as a function of the punch travel.

30. An apparatus according to claim 20, further comprising a measuring device, by which a punch force of the punch is measured or determined, wherein the coupling state is varied as a function of the punch force and/or punch travel.

31. An apparatus according to claim 20, further comprising a measuring device, by which a clamping force of the holding-down device is measured or determined, wherein the coupling state is varied as a function of the clamping force and/or punch force and/or punch travel.

32. A riveting machine comprising:

a riveting punch movable from a retracted position to an advanced and riveting position;

a first piston coupled to and being movable with the punch;

a workpiece clamp movable from a retracted position to an advanced and clamping position;

a second piston coupled to and being movable with the clamp; and fluid operably moving from a first substantially enclosed area adjacent the first piston to a second and spaced apart, substantially enclosed area adjacent the second piston.

33. The machine of claim 32 further comprising a self piercing rivet operably driven into a workpiece by the punch moving from its retracted position to its advanced position.

34. The machine of claim 33 wherein the rivet has a hollow section and an end which diverges as it moves through a workpiece.

35. The machine of claim 33 further comprising a die aligned with the punch, and the rivet being prevented from piercing completely through a die-side workpiece during riveting.

36. The machine of claim 32 further comprising a controller operably causing variations of pressure of the fluid in the areas adjacent the pistons.

37. The machine of claim 36 wherein the controller varies the pressure as a function of a characteristic associated with at least one of: (a) the punch, (b) at least one workpiece, (c) a rivet, (d) a punching force, and (e) a clamping force.

38. The machine of claim 32 wherein the areas adjacent to the pistons are chambers of fluid cylinders which advance at least partially with the punch when the punch operably moves from its retracted position to its advanced position.

39. The machine of claim 32 wherein the fluid is a liquid.

40. The machine of claim 32 wherein the fluid is air.

41. The machine of claim 32 further comprising a rotary-to-linear drive system operably causing the punch to move from its retracted position to its advanced position.

42. An apparatus for manufacturing a riveted joint, the apparatus comprising:

a workpiece clamp;

a rivet punch; and a coupling unit operably coupling movement of the clamp to movement of the punch in such a way that during a riveting operation, a coupling of the clamp to the punch is automatically varied between a coupled state and an uncoupled state in response to a sensed riveting characteristic.

43. The apparatus of claim 42 wherein the coupled state is varied as a function of the characteristic which includes at least one of: punch travel and a parameter derived from the punch travel.

44. The apparatus of claim 42 wherein the coupled state is varied as a function of the characteristic which includes material properties of at least one layer.

45. The apparatus of claim 42 wherein the coupled state is varied as a function of the characteristic which includes properties of a pairing of the layers which are of different materials.

46. The apparatus of claim 42 wherein the coupled state is varied as a function of the characteristic which includes a number of the layers.

47. The apparatus of claim 42 wherein the coupled state is varied as a function of the characteristic which includes a thickness of at least one of the layers.

48. The apparatus of claim 42 further comprising a self piercing rivet, wherein the coupled state is varied as a function of the characteristic which includes material properties of the rivet.

49. The apparatus of claim 42 further comprising a self piercing rivet, wherein the coupled state is varied as a function of the characteristic which includes hardness of the rivet.

50. The apparatus of claim 42 further comprising a self piercing rivet, wherein the coupled state is varied as a function of the characteristic which includes geometry of the rivet.

51. The apparatus of claim 42 wherein the coupled state is varied during riveting.

52. The apparatus of claim 42 further comprising a controller operably changing the coupling state by comparing the sensed riveting characteristic to at least one previously stored value.

53. The apparatus of claim 42 wherein the coupling unit includes a first fluid cylinder and a second fluid cylinder, wherein fluid is operably allowed to flow between the cylinders to vary the coupled state.

54. The apparatus of claim 42 further comprising a self piercing rivet having an open end which diverges during riveting, the rivet being operably driven by the punch, and the end being prevented from piercing through a die-side workpiece.

55. A riveting machine comprising:

a self piercing rivet having an end which operably diverges during riveting;

a riveting punch movable from a retracted position to an advanced and riveting position;

a first piston coupled to and being movable with the punch;

a workpiece clamp movable from a retracted position to an advanced and clamping position;

a second piston coupled to and being movable with the clamp;

fluid operably moving from a first substantially enclosed area adjacent the first piston to a second and spaced apart, substantially enclosed area adjacent the second piston; and a controller operably flowing the fluid between the areas in order to vary a coupling state of the punch to the clamp in response to comparisons of a sensed riveting characteristic to at least one previously stored value.

56. The machine of claim 55 further comprising a die aligned with the punch, and the rivet being prevented from piercing completely through a die-side workpiece during riveting.

57. The machine of claim 55 wherein the controller varies the pressure as a function of a characteristic associated with at least one of: (a) the punch, (b) at least one workpiece, (c) a rivet, (d) a punching force, and (e) a clamping force.

58. The machine of claim 55 wherein the areas adjacent to the pistons are chambers of fluid cylinders which advance at least partially with the punch when the punch operably moves from its retracted position to its advanced position.

59. The machine of claim 55 further comprising a rotary-to-linear drive system operably causing the punch to move from its retracted position to its advanced position.

* * * * *